US006491385B2

(12) United States Patent
Anagnostopoulos et al.

(10) Patent No.: US 6,491,385 B2
(45) Date of Patent: Dec. 10, 2002

(54) CMOS/MEMS INTEGRATED INK JET PRINT HEAD WITH ELONGATED BORE AND METHOD OF FORMING SAME

(75) Inventors: Constantine N. Anagnostopoulos, Mendon, NY (US); Gilbert A. Hawkins, Mendon, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/791,315

(22) Filed: Feb. 22, 2001

(65) Prior Publication Data

US 2002/0113848 A1 Aug. 22, 2002

(51) Int. Cl.[7] ..... B41J 2/02; B41J 2/09
(52) U.S. Cl. ..... 347/73; 347/77
(58) Field of Search ..... 347/73, 75, 77, 347/82

(56) References Cited

U.S. PATENT DOCUMENTS 5,870,121 A * 2/1999 Chan ..... 347/59
6,158,845 A * 12/2000 Chwalek et al. ..... 347/56

FOREIGN PATENT DOCUMENTS

EP 0 911 168 A2 * 4/1999 ..... B41J/2/105
EP 1 016 527 A1 * 7/2000 ..... B41J/2/09

* cited by examiner

*Primary Examiner*—Thinh Nguyen
(74) *Attorney, Agent, or Firm*—Norman Rushefsky

(57) ABSTRACT

A continuous ink jet print head is formed of a silicon substrate that includes integrated circuits formed therein for controlling operation of the print head. An insulating layer or layers overlies the silicon substrate includes conductors at various levels to provide conductive paths for transmitting control signals for controlling the print head. The insulating layer or layers also has a series or an array of nozzle openings or bores formed therein along the length of the substrate to provide a substantially planar surface to facilitate cleaning of the printhead. Each nozzle opening is formed as an elongated bore that extends through the insulating layer or layers to the silicon substrate. A heater element is formed adjacent each nozzle opening and in proximity to the planar surface to provide asymmetric heating of the ink stream as it leaves the nozzle opening.

18 Claims, 11 Drawing Sheets

CM OS/MEMS INTEGRATED INK JET PRINT HEAD WITH ELONGATED BORE AND METHOD OF FORMING SAME

FIELD OF THE INVENTION

This invention generally relates to the field of digitally controlled printing devices, and in particular to liquid ink print heads which integrate multiple nozzles on a single substrate and in which a liquid drop is selected for printing by thermo-mechanical means.

BACKGROUND OF THE INVENTION

Inkjet printing has become recognized as a prominent contender in the digitally controlled, electronic printing arena because, e.g., of its non-impact, low noise characteristics and system simplicity. For these reasons, ink jet printers have achieved commercial success for home and office use and other areas.

Inkjet printing mechanisms can be categorized as either continuous (CIJ) or Drop-on-Demand (DOD). U.S. Pat. No. 3,946,398, which issued to Kyser et al. in 1970, discloses a DOD ink jet printer which applies a high voltage to a piezoelectric crystal, causing the crystal to bend, applying pressure on an ink reservoir and jetting drops on demand. Piezoelectric DOD printers have achieved commercial success at image resolutions greater than 720 dpi for home and office printers. However, piezoelectric printing mechanisms usually require complex high voltage drive circuitry and bulky piezoelectric crystal arrays, which are disadvantageous in regard to number of nozzles per unit length of print head, as well as the length of the print head. Typically, piezoelectric print heads contain at most a few hundred nozzles.

Great Britain Patent No. 2,007,162, which issued to Endo et al., in 1979, discloses an electrothermal drop-on-demand ink jet printer that applies a power pulse to a heater which is in thermal contact with water based ink in a nozzle. A small quantity of ink rapidly evaporates, forming a bubble, which causes a drop of ink to be ejected from small apertures along an edge of a heater substrate. This technology is known as thermal ink jet or bubble jet.

Thermal ink jet printing typically requires that the heater generates an energy impulse enough to heat the ink to a temperature near 400 degrees C. which causes a rapid formation of a bubble. The high temperatures needed with this device necessitate the use of special inks, complicates driver electronics, and precipitates deterioration of heater elements through cavitation and kogation. Kogation is the accumulation of ink combustion by-products that encrust the heater with debris. Such encrusted debris interferes with the thermal efficiency of the heater and thus shorten the operational life of the print head. And, the high active power consumption of each heater prevents the manufacture of low cost, high speed and page wide print heads.

Continuous ink jet printing itself dates back to at least 1929. See U.S. Pat. No. 1,941,001 which issued to Hansell that year.

U.S. Pat. No. 3,373,437 which issued to Sweet et al. in March 1968, discloses an array of continuous ink jet nozzles wherein ink drops to be printed are selectively charged and deflected towards the recording medium. This technique is known as binary deflection continuous ink jet printing, and is used by several manufacturers, including Elmjet and Scitex.

U.S. Pat. No. 3,416,153, issued to Hertz et al. in December 1968. This patent discloses a method of achieving variable optical density of printed spots, in continuous ink jet printing. The electrostatic dispersion of a charged drop stream serves to modulatate the number of droplets which pass-through a small aperture. This technique is used in ink jet printers manufactured by Iris.

U.S. Pat. No. 4,346,387, entitled METHOD AND APPARATUS FOR CONTROLLING THE ELECTRIC CHARGE ON DROPLETS AND INK JET RECORDER INCORPORATING THE SAME issued in the name of Carl H. Hertz on Aug. 24, 1982. This patent discloses a CIJ system for controlling the electrostatic charge on droplets. The droplets are formed by breaking up of a pressurized liquid stream, at a drop formation point located within an electrostatic charging tunnel, having an electrical field. Drop formation is effected at a point in the electrical field corresponding to whatever predetermined charge is desired. In addition to charging tunnels, deflection plates are used to actually deflect the drops. The Hertz system requires that the droplets produced be charged and then deflected into a gutter or onto the printing medium. The charging and deflection mechanisms are bulky and severely limit the number of nozzles per print head.

Until recently, conventional continuous ink jet techniques all utilized, in one form or another, electrostatic charging tunnels that were placed close to the point where the drops are formed in the stream. In the tunnels, individual drops may be charged selectively. The selected drops are charged and deflected downstream by the presence of deflector plates that have a large potential difference between them. A gutter (sometimes referred to as a "catcher") is normally used to intercept the charged drops and establish a non-print mode, while the uncharged drops are free to strike the recording medium in a print mode as the ink stream is thereby deflected, between the "non-print" mode and the "print" mode. Typically, the charging tunnels and drop deflector plates in continuous ink jet printers operate at large voltages, for example 100 volts or more, compared to the voltages commonly considered damaging to conventional CMOS circuitry, typically 25 volts or less. Additionally, there is a need for the inks in electrostatic continuous ink jet printers to be conductive and to carry current. As is well known in the art of semiconductor manufacture, it is undesirable from the point in view of reliability to pass current bearing liquids in contact with semiconductor surfaces. Thus the manufacturer of continuous ink jet print heads has not been generally integrated with the manufacture of CMOS circuitry.

Recently, a novel continuous ink jet printer system has been developed which renders the above-described electrostatic charging tunnels unnecessary. Additionally, it serves to better couple the functions of (1) droplet formation and (2) droplet deflection. That system is disclosed in the commonly assigned U.S. Pat. No. 6,079,821 entitled CONTINUOUS INK JET PRINTER WITH ASYMMETRIC HEATING DROP DEFLECTION filed in the names of James Chwalek, Dave Jeanmaire and Constantine Anagnostopoulos, the contents of which are incorporated herein by reference. This patent discloses an apparatus for controlling ink in a continuous ink jet printer. The apparatus comprises an ink delivery channel, a source of pressurized ink in communication with the ink delivery channel, and a nozzle having a bore which opens into the ink delivery channel, from which a continuous stream of ink flows. Periodic application of weak heat pulses to the stream by a heater causes the ink stream to break up into a plurality of droplets synchronously with the applied heat pulses and at a position spaced from the nozzle. The droplets are deflected by increased heat pulses from the heater (in the nozzle bore) which heater has a selectively actuated section, i.e. the section associated with only a portion of the nozzle bore. Selective actuation of a particular heater section, constitutes what has been termed an asymmetrical application of heat to the stream. Alternating the sections can, in turn, alternate the direction in which this asymmetrical heat is supplied and serves to thereby deflect ink drops, inter alia, between a "print" direction (onto a recording medium) and a "non-print" direction (back into a "catcher"). The patent of Chwalek et al. thus provides a liquid printing system that affords significant improvements toward overcoming the prior art problems associated with the number of nozzles per print head, print head length, power usage and characteristics of useful inks.

Asymmetrically applied heat results in stream deflection, the magnitude of which depends upon several factors, e.g. the geometric and thermal properties of the nozzles, the quantity of applied heat, the pressure applied to, and the physical, chemical and thermal properties of the ink.

The invention to be described herein builds upon the work of Chwalek et al. in terms of constructing continuous ink jet printheads that are suitable for low-cost manufacture and preferably for printheads that can be made page wide.

Although the invention may be used with ink jet print heads that are not considered to be page wide print heads there remains a widely recognized need for improved ink jet printing systems, providing advantages for example, as to cost, size, speed, quality, reliability, small nozzle orifice size, small droplets size, low power usage, simplicity of construction and operation, durability and manufacturability. In this regard, there is a particular long-standing need for the capability to manufacture page wide, high resolution ink jet print heads. As used herein, the term "page wide" refers to print heads of a minimum length of about four inches. High-resolution implies nozzle density, for each ink color, of a minimum of about 300 nozzles per inch to a maximum of about 2400 nozzles per inch.

To take full advantage of page wide print heads with regard to increased printing speed they must contain a large number of nozzles. For example, a conventional scanning type print head may have only a few hundred nozzles per ink color. A four inch page wide printhead, suitable for the printing of photographs, should have a few thousand nozzles. While a scanned printhead is slowed down by the need for mechanically moving it across the page, a page wide printhead is stationary and paper moves past it. The image can theoretically be printed in a single pass, thus substantially increasing the printing speed.

There are two major difficulties in realizing page wide and high productivity ink jet print heads. The first is that nozzles have to be spaced closely together, of the order of 10 to 80 micrometers, center to center spacing. The second is that the drivers providing the power to the heaters and the electronics controlling each nozzle must be integrated with each nozzle, since attempting to make thousands of bonds or other types of connections to external circuits is presently impractical.

One way of meeting these challenges is to build the print heads on silicon wafers utilizing VLSI technology and to integrate the CMOS circuits on the same silicon substrate with the nozzles.

While a custom process, as proposed in the patent to Silverbrook, U.S. Pat. No. 5,880,759 can be developed to fabricate the print heads, from a cost and manufacturability point of view it is preferable to first fabricate the circuits using a standard CMOS process in a conventional VLSI facility. Then, to post process the wafers in a separate MEMS (micro-electromechanical systems) facility for the fabrication of the nozzles and ink channels.

SUMMARY OF THE INVENTION

It is therefore an object of the invention to provide a CIJ printhead that may be fabricated at lower cost and improved manufacturability as compared to those ink jet printheads known in the prior art that require more custom processing.

It is another object of the invention to provide a CIJ printhead that has a planar surface to facilitates easier cleaning of the printhead surface and has an elongated bore for a straighter jet of ink stream flow.

In accordance with a first aspect of the invention there is provided an ink jet print head comprising a silicon substrate including integrated circuits formed therein for controlling operation of the print head, the silicon substrate having one or more ink channels formed therein along the substrate; an insulating layer or layers overlying the silicon substrate, the insulating layer or layers having a series of elongated ink jet bores each formed in the surface of the insulating layer or layers, the surface being formed generally planar, and each bore extending from the surface of the insulating layer or layers to an ink channel in the silicon substrate; and each bore having located proximate thereto and near the surface of the insulating layer or layers a heater element.

In accordance with a second aspect of the invention, there is provided a method of operating a continuous ink jet print head comprising the ink jet print head of claim 1 wherein the insulating layer or layers includes a series of vertically separated levels of electrically conductive leads and electrically conductive vias connect at least some of said levels.

In accordance with a third aspect of the invention, there is provided a method of forming a continuous ink jet print head comprising the ink jet print head of claim 1 wherein the insulating layer or layers is formed of an oxide.

These and other objects, features and advantages of the present invention will become apparent to those skilled in the art upon reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings.

DETAILED DESCRIPTION OF THE INVENTION

This description will be directed in particular to elements forming part of, or cooperating more directly with, apparatus in accordance with the present invention. It is to be understood that elements not specifically shown or described may take various forms well known to those skilled in the art.

Figure 8:
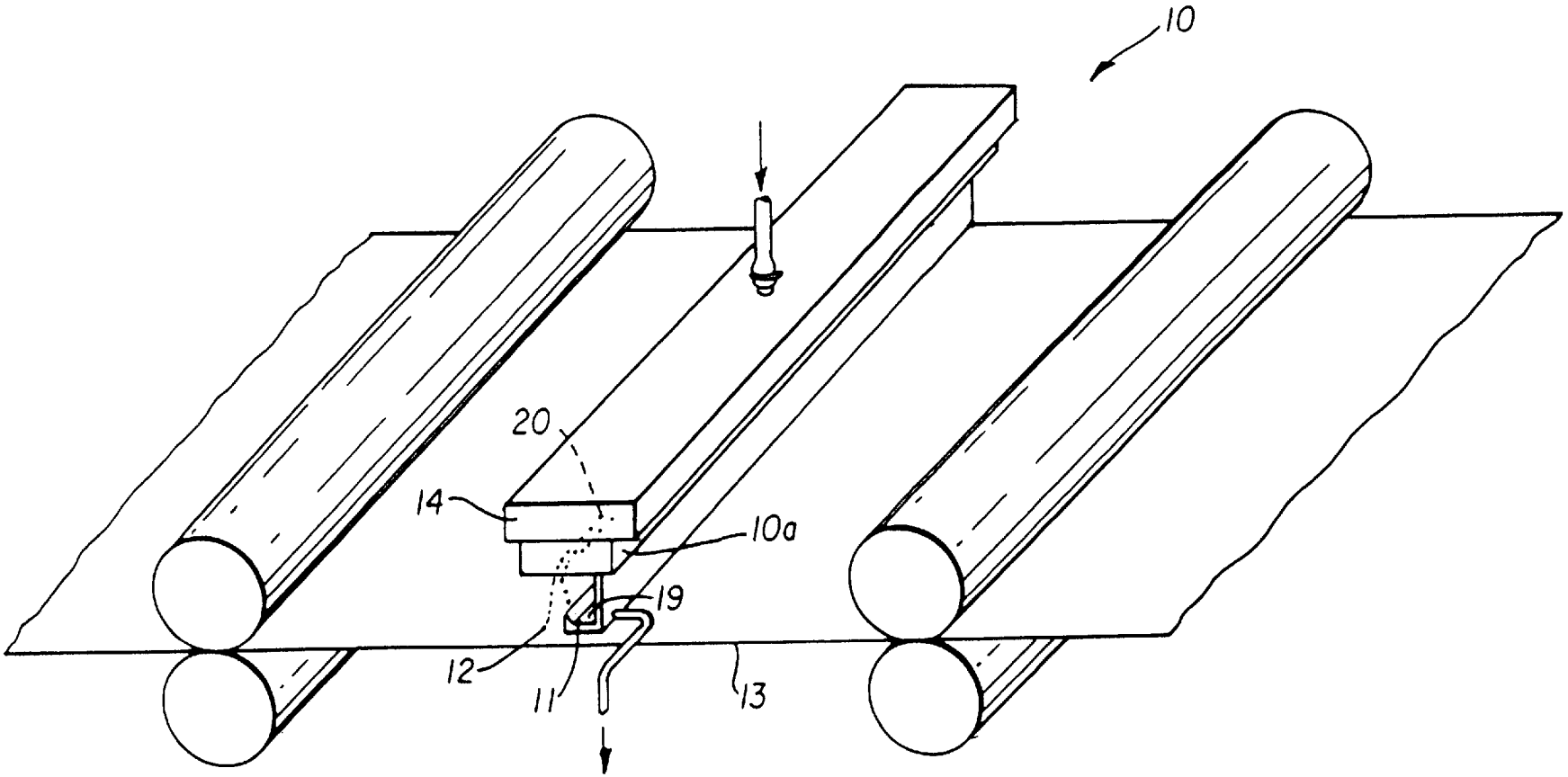
FIG. 8 illustrates a schematic diagram of an exemplary continuous ink jet print head and nozzle array as a print medium (e.g. paper) rolls or is transported under the ink jet print head.

Referring to FIG. 8, a continuous ink jet printer system is generally shown at 10. The printhead 10*a,* from which extends an array of nozzles 20, contains heater control circuits (not shown).

Heater control circuits read data from an image memory, and send time-sequenced electrical pulses to the heaters of the nozzles of nozzle array 20. These pulses are applied an appropriate length of time, and to the appropriate nozzle, so that drops formed from a continuous ink jet stream will form spots on a recording medium 13, in the appropriate position designated by the data sent from the image memory. Pressurized ink travels from an ink reservoir (not shown) to an ink delivery channel, built inside member 14 and through nozzle array 20 on to either the recording medium 13 or the gutter 19. The ink gutter 19 is configured to catch undeflected ink droplets 11 while allowing deflected droplets 12 to reach a recording medium. The general description of the continuous ink jet printer system of FIG. 13 is also suited for use as a general description in the printer system of the invention.

Figure 1:
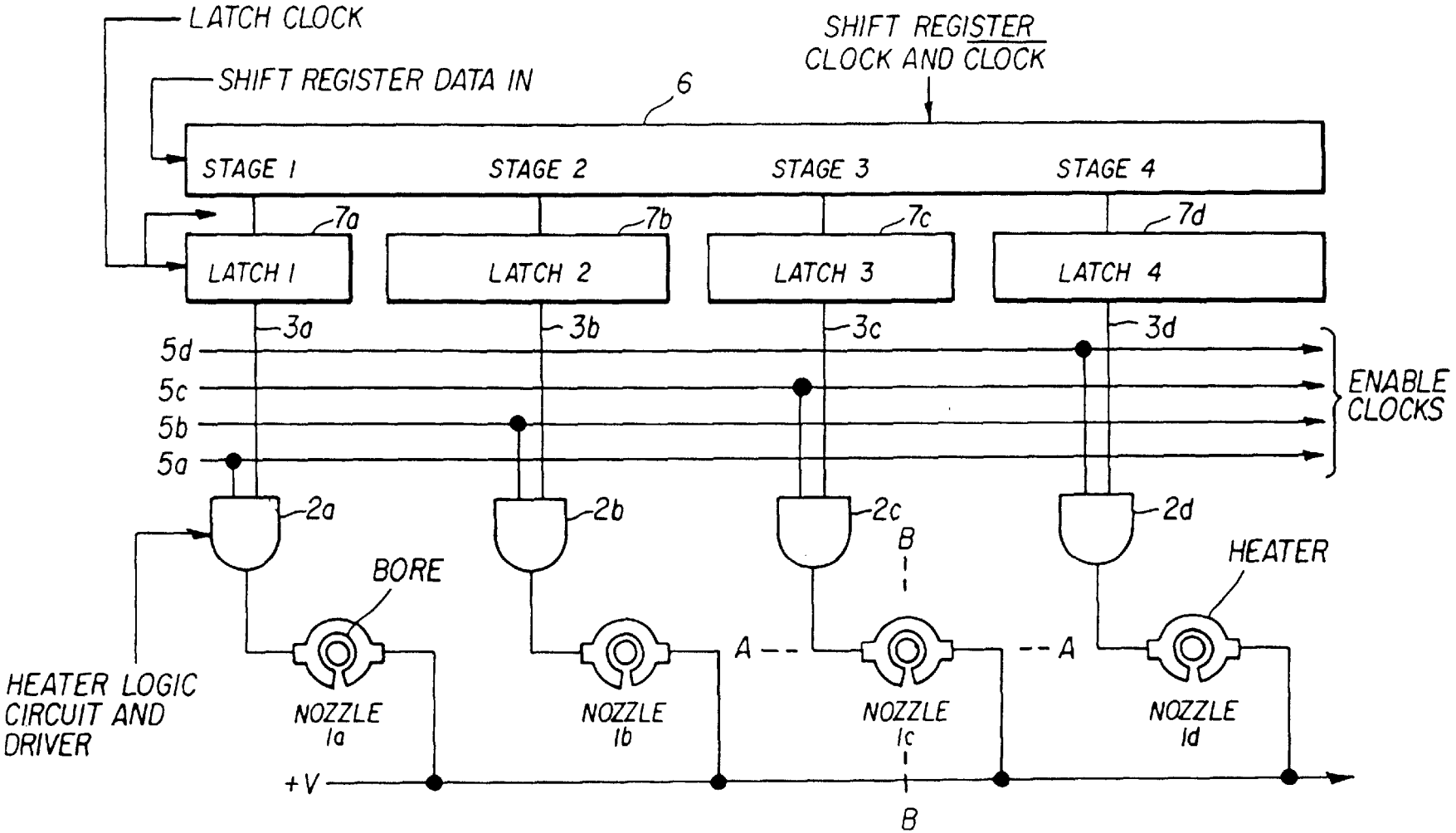
FIG. 1 is a schematic and fragmentary top view of a print head constructed in accordance with the present invention.

Referring to FIG. 1, there is shown a top view of an ink jet print head according to the teachings of the present invention. The print head comprises an array of nozzles 1*a*–1*d* arranged in a line or a staggered configuration. Each nozzle is addressed by a logic AND gate (2*a*–2*d*) each of which contains logic circuitry and a heater driver transistor (not shown). The logic circuitry causes a respective driver transistor to turn on if a respective signal on a respective data input line (3*a*–3*d*) to the AND gate (2*a*–2*d*) and the respective enable clock lines (5*a*–5*d*), which is connected to the logic gate, are both logic ONE. Furthermore, signals on the enable clock lines (5*a*–5*d*) determine durations of the lengths of time current flows through the heaters in the particular nozzles 1*a*–1*d*. Data for driving the heater driver transistor may be provided from processed image data that is input to a data shift register 6. The latch register 7*a*–7*d,* in response to a latch clock, receives the data from a respective shift register stage and provides a signal on the lines 3*a*–3*d* representative of the respective latched signal (logical ONE or ZERO) representing either that a dot is to be printed or not on a receiver. In the third nozzle, the lines A—A and B—B define the direction in which crosssectional views are taken.

Figure 1A:
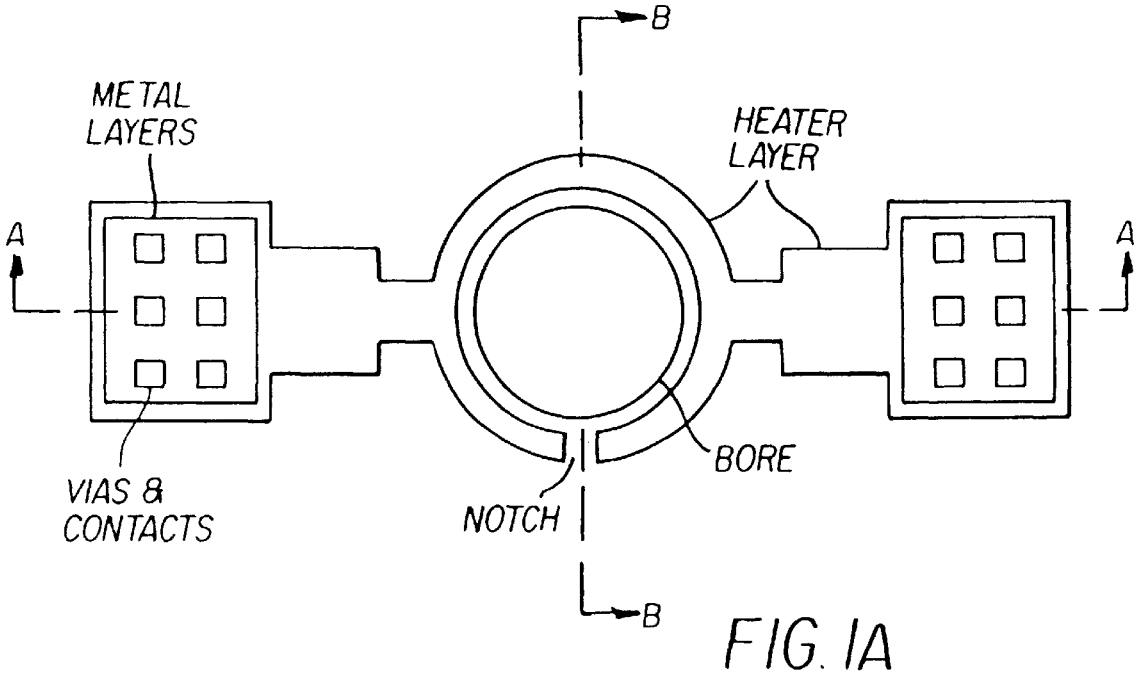
FIG. 1A is a simplified top view of a nozzle with a "notch" type heater for a CIJ print head in accordance with the invention.
Figure 1B:
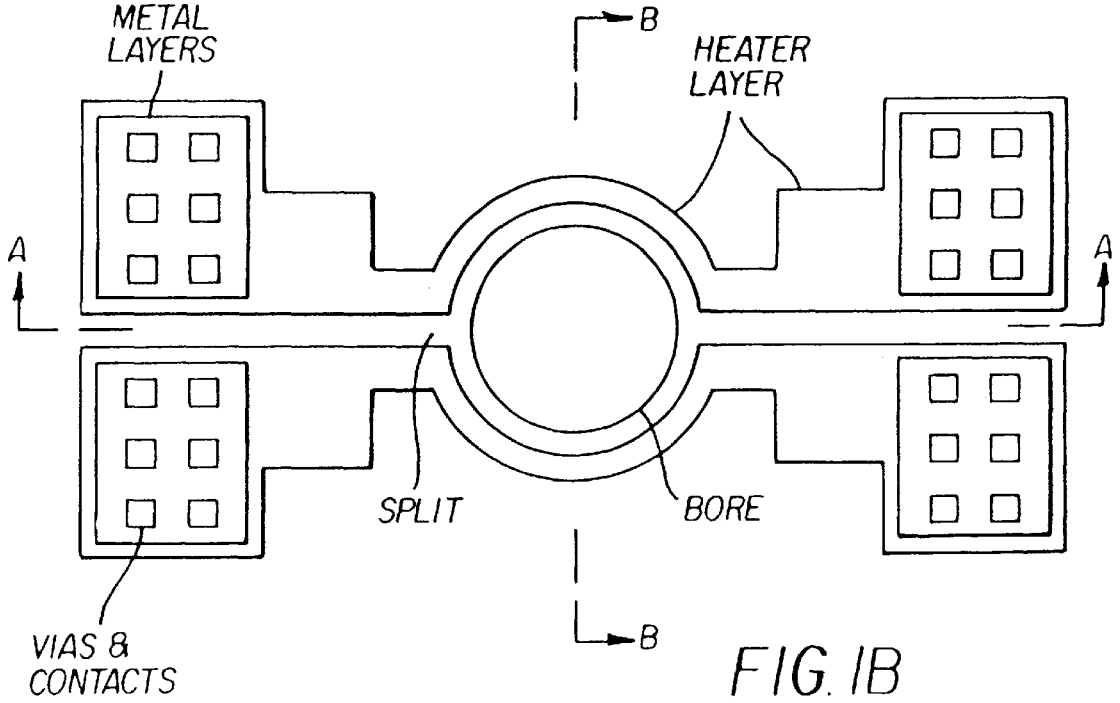
FIG. 1B is a simplified top view of a nozzle with a split type eater for a CIJ print head made in accordance with the invention.

FIGS. 1A and 1B show more detailed top views of the two types of assymetric heaters (the "notch type" and "split type" respectively) used in CIJ print heads. They produce asymmetric heating of the jet and thus cause ink jet deflection. Asymmetrical application of heat merely means supplying electrical current to one or the other section of the heater independently in the case of a split type heater. In the case of a notch type heater applied current to the notch type heater will inherently involve an asymmetrical heating of the ink. With reference now to FIG. 1A there is illustrated a top view of an ink jet printhead nozzle with a notched type heater. The heater is formed adjacent the exit opening of the nozzle. The heater element material substantially encircles the nozzle bore but for a very small notched out area, just enough to cause an electrical open. These nozzle bores and associated heater configurations are illustrated as being circular, but can be non-circular as disclosed by Jeanmaire et al. in commonly assigned U.S. application Ser. No. 09/466,346 filed Dec. 17, 1999, the contents of which are incorporated herein by reference. As noted also with reference to FIG. 1 one side of each heater is connected to a common bus line, which in turn is connected to the power supply typically +5 volts. The other side of each heater is connected to a logic AND gate within which resides an MOS transistor driver capable of delivering up to 30 mA of current to that heater. The AND gate has two logic inputs. One is from the Latch 7*a*–*d* which has captured the information from the respective shift register stage indicating whether the particular heater will be activated or not during the present line time. The other input is the enable clock that determines the length of time and sequence of pulses that are applied to the particular heater. Typically there are two or more enable clocks in the printhead so that neighboring heaters can be turned on at slightly different times to avoid thermal and other cross talk effects.

With reference to FIG. 1B there is illustrated the nozzle with a split type heater wherein there are essentially two semicircular heater elements surrounding the nozzle bore adjacent the exit opening thereof. Separate conductors are provided to the upper and lower segments of each semi circle, it being understood that in this instance upper and lower refer to elements in the same plane. Vias are provided that electrically contact the conductors to metal layers associated with each of these conductors. These metal layers are in turn connected to driver circuitry formed on a silicon substrate as will be described below.

Figure 2:
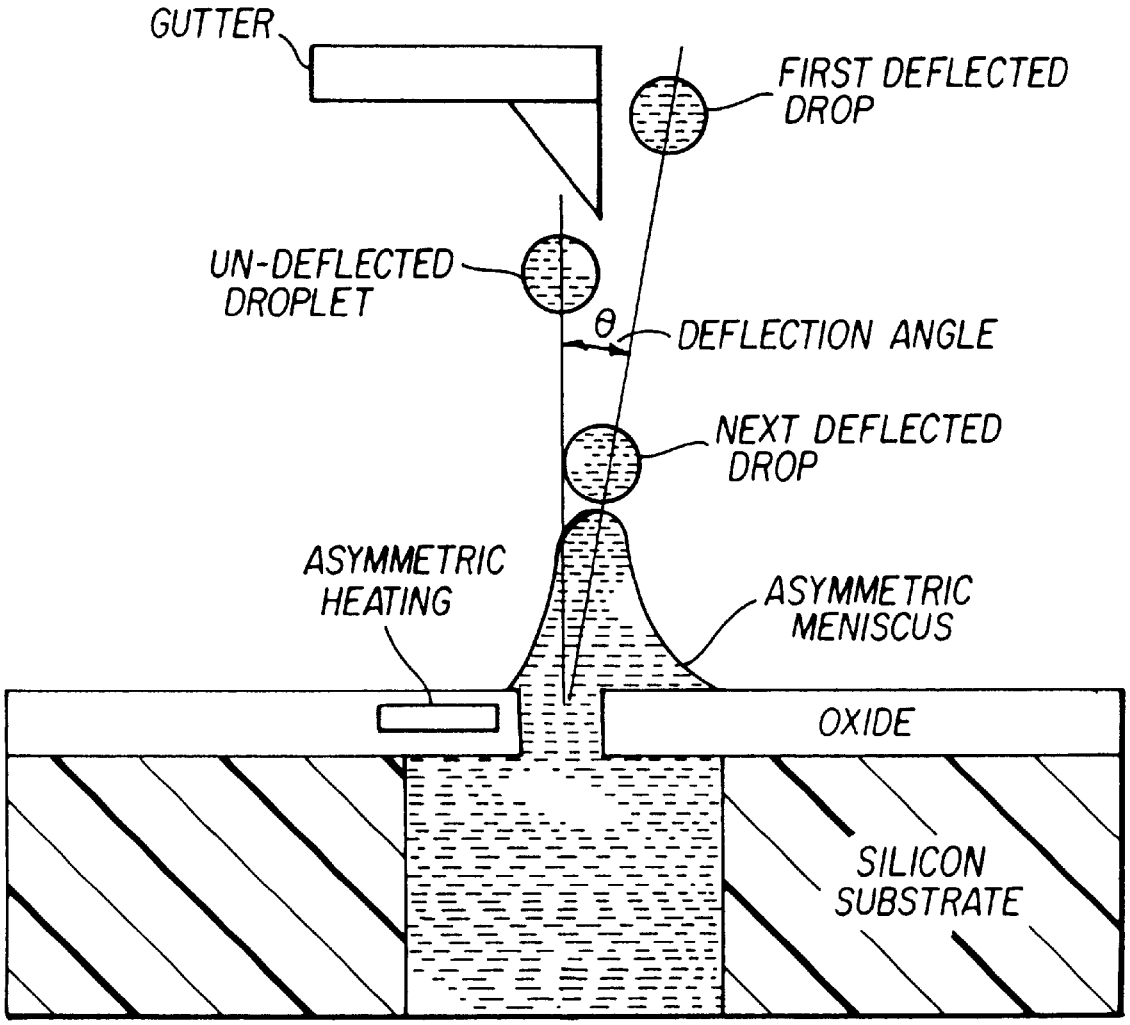
FIG. 2 is cross-sectional view of the nozzle with notch type eater, the sectional view taken along line B—B of FIG. 1A.

In FIG. 2 there is shown a simplified cross-sectional view of an operating nozzle across the B—B direction. As mentioned above, there is an ink channel formed under the nozzle bores to supply the ink. This ink supply is under pressure typically between 15 to 25 psi for a bore diameter of about 8.8 micrometers. The ink in the delivery channel emanates from a pressurized reservoir (not shown), leaving the ink in the channel under pressure. The constant pressure can be achieved by employing an ink pressure regulator (not shown). Without any current flowing to the heater, a jet forms that is straight and flows directly into the gutter. On the surface of the printhead a symmetric meniscus forms around each nozzle that is a few microns larger in diameter than the bore. If a current pulse is applied to the heater, the meniscus in the heated side pulls in and the jet deflects away from the heater. The droplets that form then bypass the gutter and land on the receiver. When the current through the heater is returned to zero, the meniscus becomes symmetric again and the jet direction is straight. The device could just as easily operate in the opposite way, that is, the deflected droplets are directed into the gutter and the printing is done on the receiver with the non-deflected droplets. Also, having all the nozzles in a line is not absolutely necessary. It is just simpler to build a gutter that is essentially a straight edge rather than one that has a staggered edge that reflects the staggered nozzle arrangement.

In typical operation, the heater resistance is of the order of 400 ohms, the current amplitude is between 10 to 20 mA, the pulse duration is about 2 microseconds and the resulting deflection angle for pure water is of the order of a few degrees, in this regard reference is made to U.S. application Ser. No. 09/221,256, entitled "Continuous Ink Jet Printhead Having Power-Adjustable Multi-Segmented Heaters" and to U.S. application Ser. No. 09/221,342 entitled "Continuous Ink Jet Printhead Having Multi-Segmented Heaters", both filed Dec. 28, 1998.

The application of periodic current pulses causes the jet to break up into synchronous droplets, to the applied pulses. These droplets form about 100 to 200 micrometers away from the surface of the printhead and for an 8.8 micrometers diameter bore and about 2 microseconds wide, 200 kHz pulse rate, they are typically 3 to 4 pL in volume but may be less or more depending upon bore size and frequency (pulse rate of current pulses).

Figure 3A:
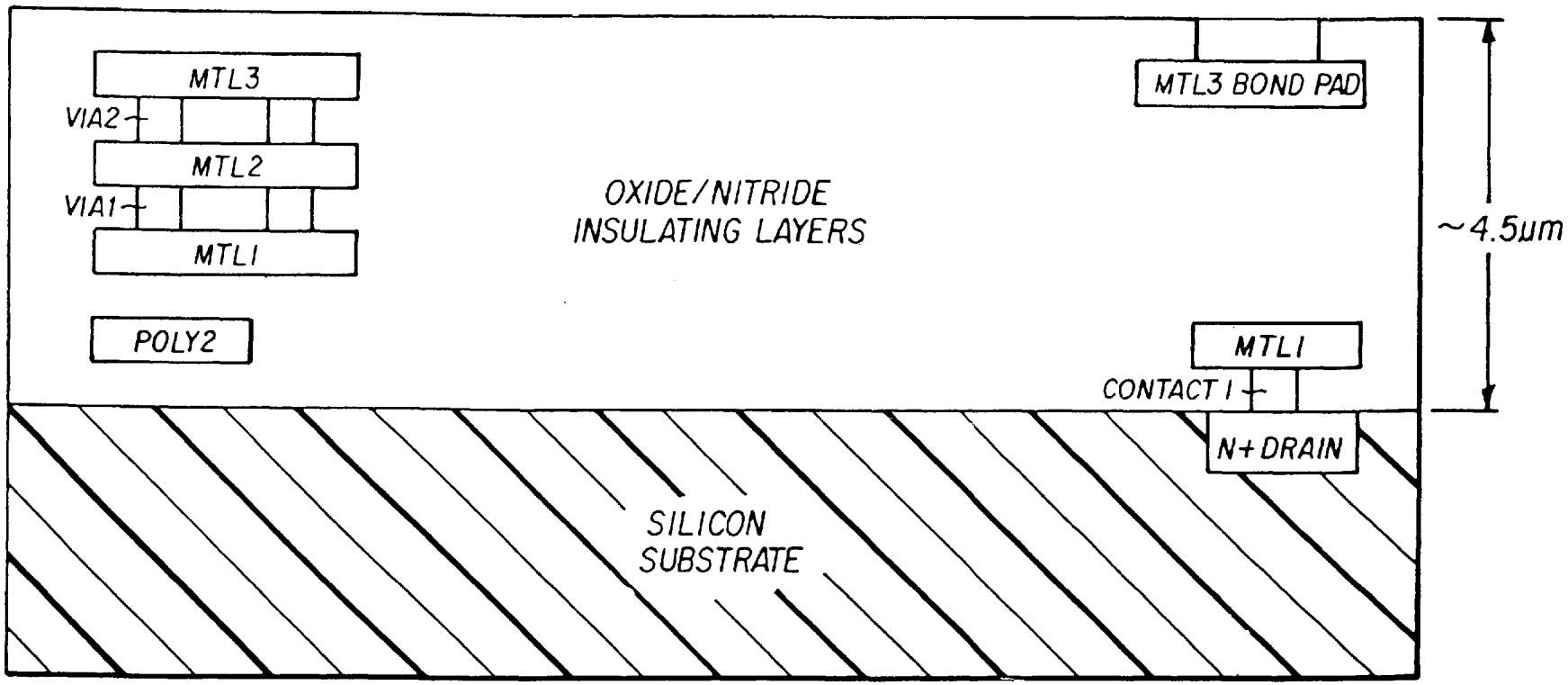
FIG. 3A is a simplified schematic sectional view taken along line A-B of FIG. 1A and illustrating the nozzle area just after the completion of all the conventional CMOS fabrication steps in accordance with the invention except for formation of heater elements, a heater passivation layer and etching of a nozzle bore.

The cross-sectional view taken along sectional line A-B and shown in FIG. 3A represents an incomplete stage in the formation of a printhead in which nozzles are to be later formed in an array wherein CMOS circuitry is integrated on the same silicon substrate.

As was mentioned earlier, the CMOS circuitry is fabricated first on the silicon wafers as one or more integrated circuits. The CMOS process may be a standard 0.5 micrometers mixed signal process incorporating two levels of polysilicon and three levels of metal on a six inch diameter wafer. Wafer thickness is typically 675 micrometers. In FIG. 3, this process is represented by the three layers of metal, shown interconnected with vias. Also polysilicon level 2 and an N+ diffusion and contact to metal layer 1 are drawn to indicate active circuitry in the silicon substrate. The gate electrodes for the CMOS transistors are formed from one of the polysilicon layers. As used herein, the term "polysilicon" assumes it is a doped polysilicon which is conductive so as to be useful as gate electrode for CMOS transistor devices.

Because of the need to electrically insulate the metal layers, dielectric layers are deposited between them making the total thickness of the film on top of the silicon wafer about 4.5 micrometers.

The structure illustrated in FIG. 3A basically would provide the necessary transistors and logic gates for providing the control components illustrated in FIG. 1.

As a result of the conventional CMOS fabrication steps a silicon substrate of approximately 675 micrometers in thickness and about 6 inches in diameter is provided. Larger or smaller diameter silicon wafers can be used equally as well. A plurality of transistors are formed in the silicon substrate through conventional steps of selectively depositing various materials to form these transistors as is well known. Supported on the silicon substrate are a series of layers eventually forming an oxide/nitride insulating layer that has one or more layers of polysilicon and metal layers formed therein in accordance with desired pattern. Vias are provided between various layers as needed and openings to the bond pads. The various bond pads are provided to make respective connections of data, latch clock, enable clocks, and power provided from a circuit board mounted adjacent the printhead or from a remote location. Although only one of the bond pads is shown it will be understood that multiple bond pads are formed in the nozzle array. As indicated in FIG. 3A, the oxide/nitride insulating layers is about 4.5 micrometers in thickness. The structure illustrated in FIG. 3 basically would provide the necessary interconnects, transistors and logic gates for providing the control components illustrated in FIG. 1.

Figure 3B:
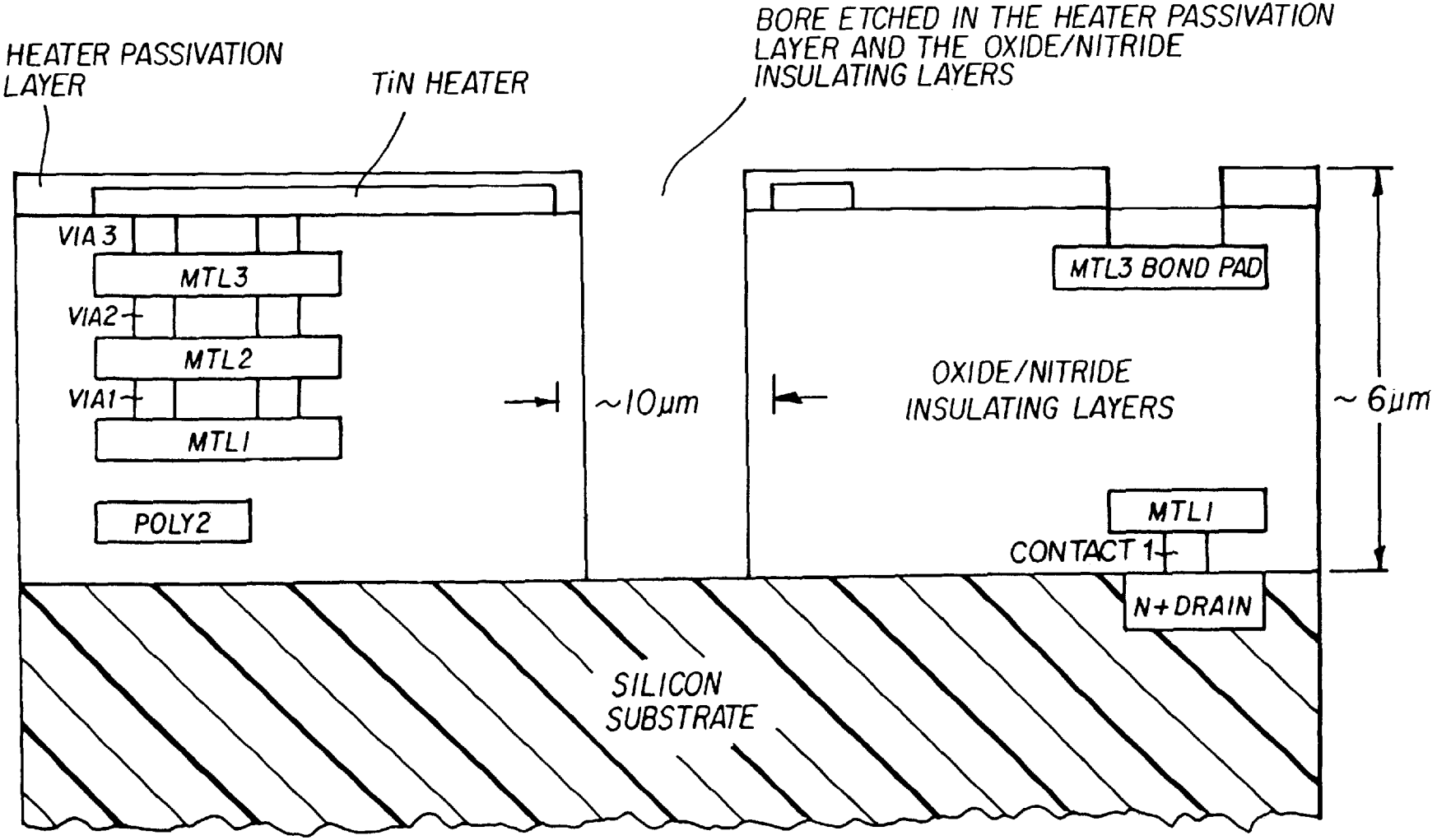
FIG. 3B is a similar view to that of FIG. 3A but after completion of all the CMOS fabrication steps in accordance with the invention.

Reference will now be made to the nozzle array structure illustrated in FIG. 3B. A dielectric layer, such as $Si_3N_4$ or $SiO_2$, is deposited on the surface of the wafer followed by a chemical mechanical polishing step (CMP) to obtain a flat surface. Vias are then opened (via3) in the top dielectric layer above the metal 3 layer followed by deposition of a thin Ti/TiN film and then a much thicker W (tungsten, wolfram) film. The surface is then planarized in a CMP (chemical mechanical polishing) process sequence that removes the W and TiN films from everywhere except from inside the via3's.

Afterwards a fresh Ti/TiN layer is deposited of about 50 angstroms of Ti and 600 angstroms of TiN. This composite film, annealed at 420 degrees C. for about 20 minutes in forming gas, achieves a sheet resistance of about 20 ohms/square. A lithography and etching steps are performed next to define the heater pattern. The wafers are then coated with a 3000 angstroms film of PECVD $Si_3N_4$ and another 3500 angstroms film of PECVD $SiO_2$ for protection of the heaters from chemical attack or mechanical abrasion.

Two more lithography and etching steps are performed next. The first to expose the bond pads and the second to create the bore. In etching of the oxide/nitride bore, an advantage is provided in having the silicon provide a natural stop to the etching process for forming the bore. Bore diameters may be in the range of 1 micrometer to 100 micrometers, with the preferred range being 6 micrometers to 16 micrometers.

The wafers are then thinned from their standard thickness of about 675 micrometers to about 300 micrometers by grinding and polishing their backsides.

Then, thick photoresist is applied to the backsides of the wafers and the ink channel pattern is defined. This pattern is aligned to targets in the fronts of the wafers, so that the bore opening and the ink channel are correctly aligned. This front to back alignment process has a misalignment accuracy of about 2 micrometers when the Karl Suss 1X aligner system is used. The ink channels are then etched in the STS deep silicon etch system.

Figure 4:
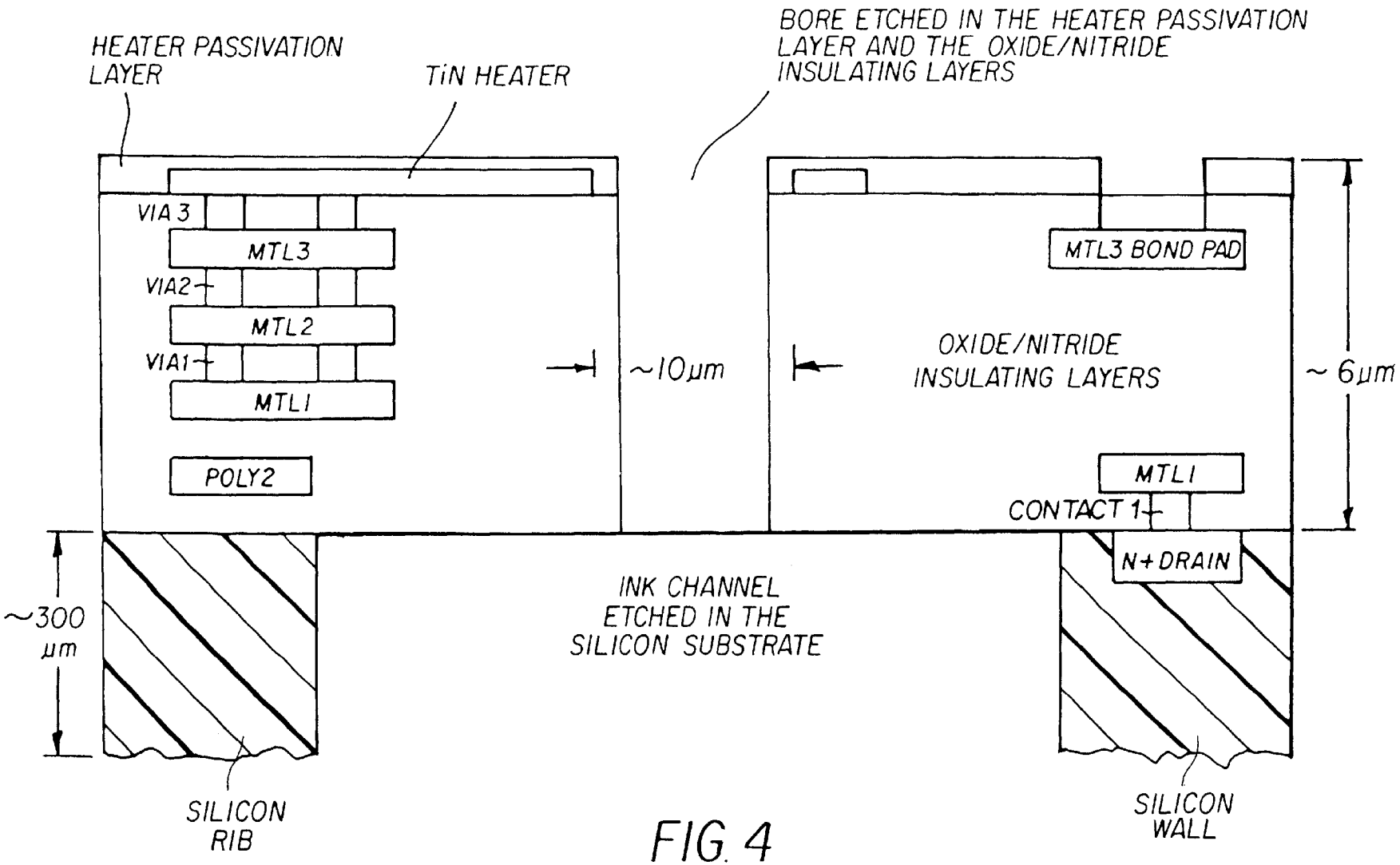
FIG. 4 is a schematic sectional view taken along line A-B of a CMOS compatible nozzle fabricated in accordance with the invention.

A simplified cross-sectional view along A-B of a finished nozzle is shown in FIG. 4. The nozzle illustrated has a deep bore, about 6 micrometers in length and 10 micrometers generally uniform in diameter and produces a jet that is highly axially directed unless asymmetric heating is provided to cause deflection of the stream.

Figure 5:
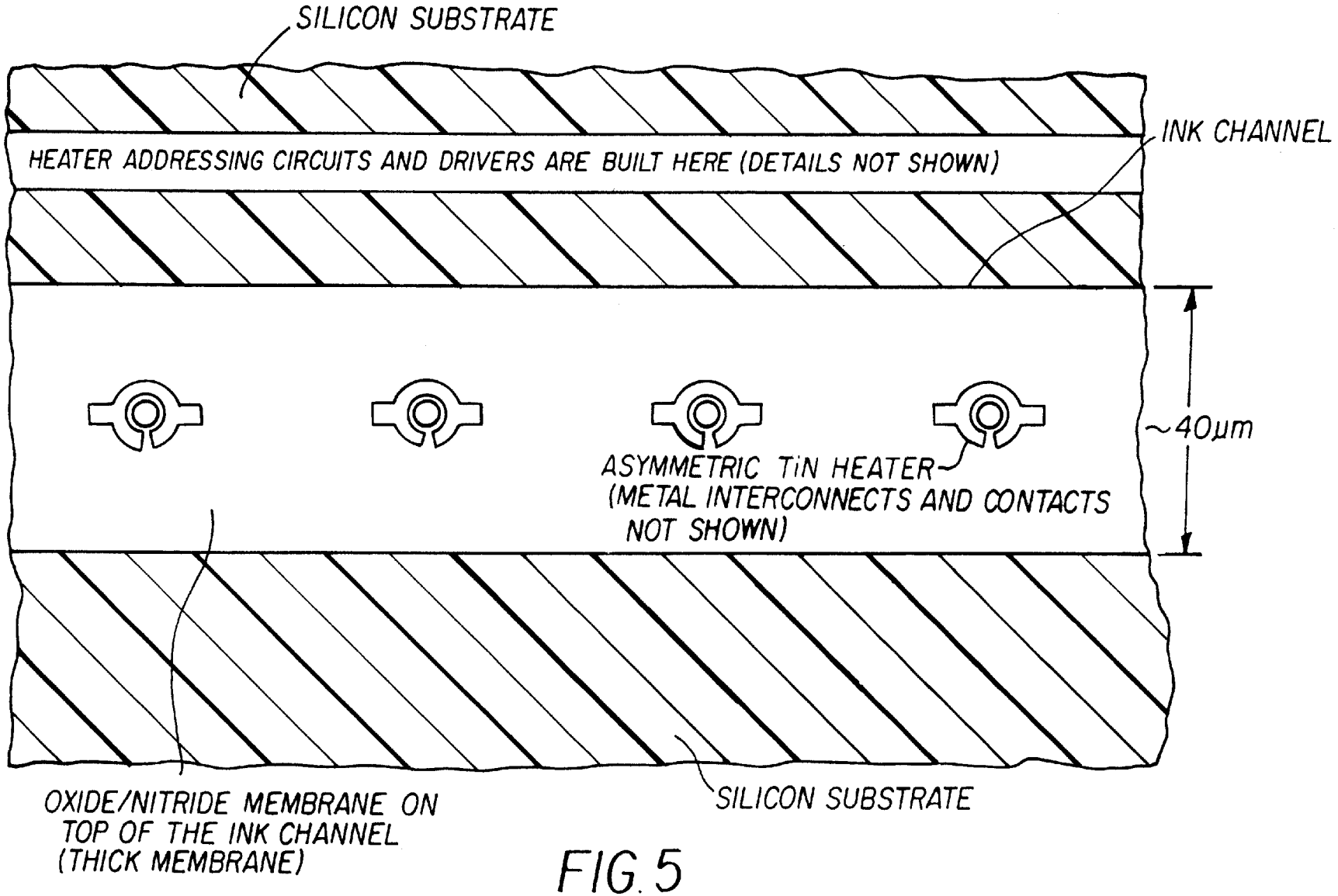
FIG. 5 is a schematic top view of the nozzle area but illustrating a central channel which extends through the silicon substrate.
Figure 6:
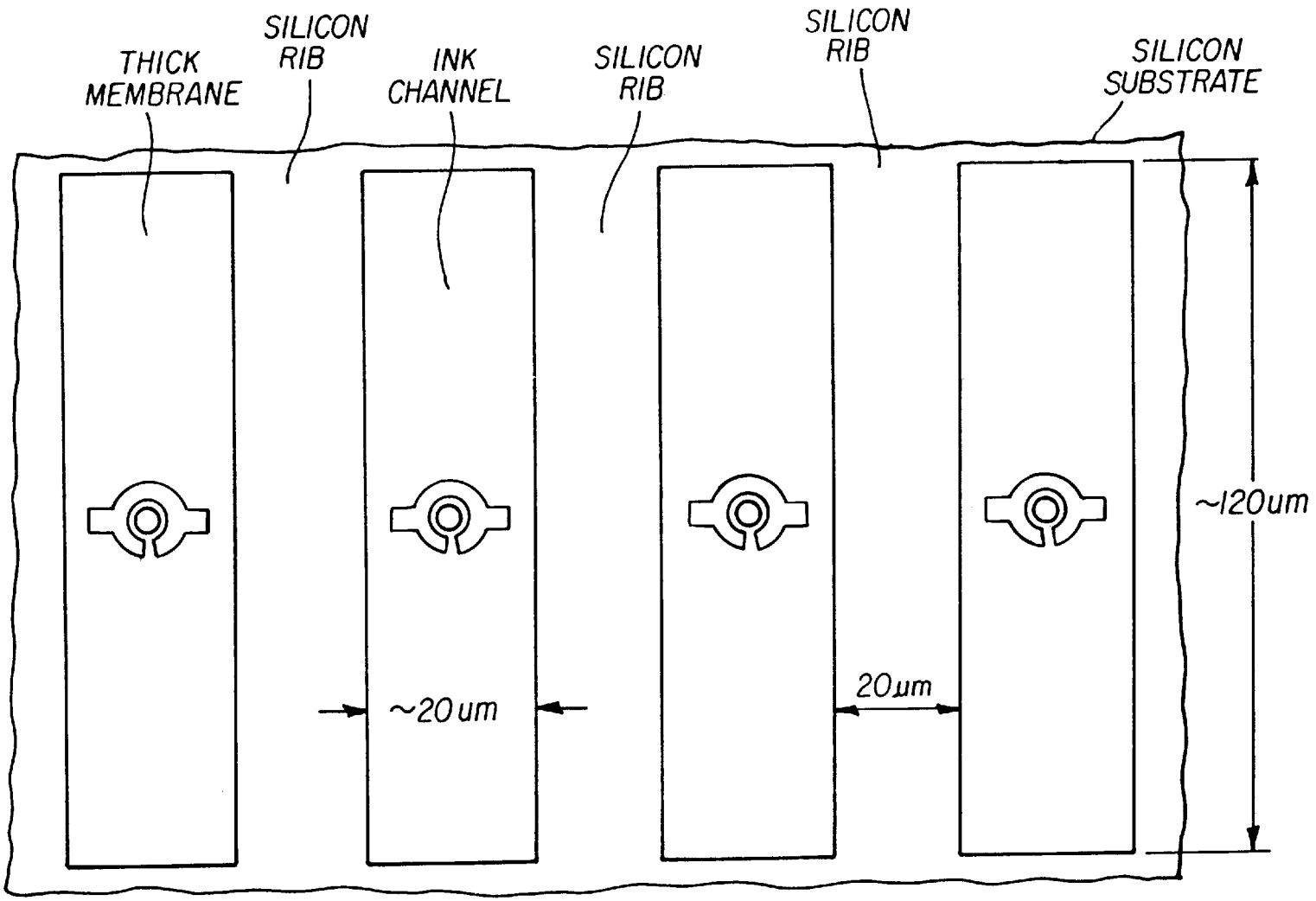
FIG. 6 is a view similar to that of FIG. 5 but illustrating rib structures formed in the silicon wafer that separate each nozzle and which provide increased structural strength and reduce wave action in the ink channel. The rib structures not actually being visible in this view but shown for illustrative purposes.
Figure 7:
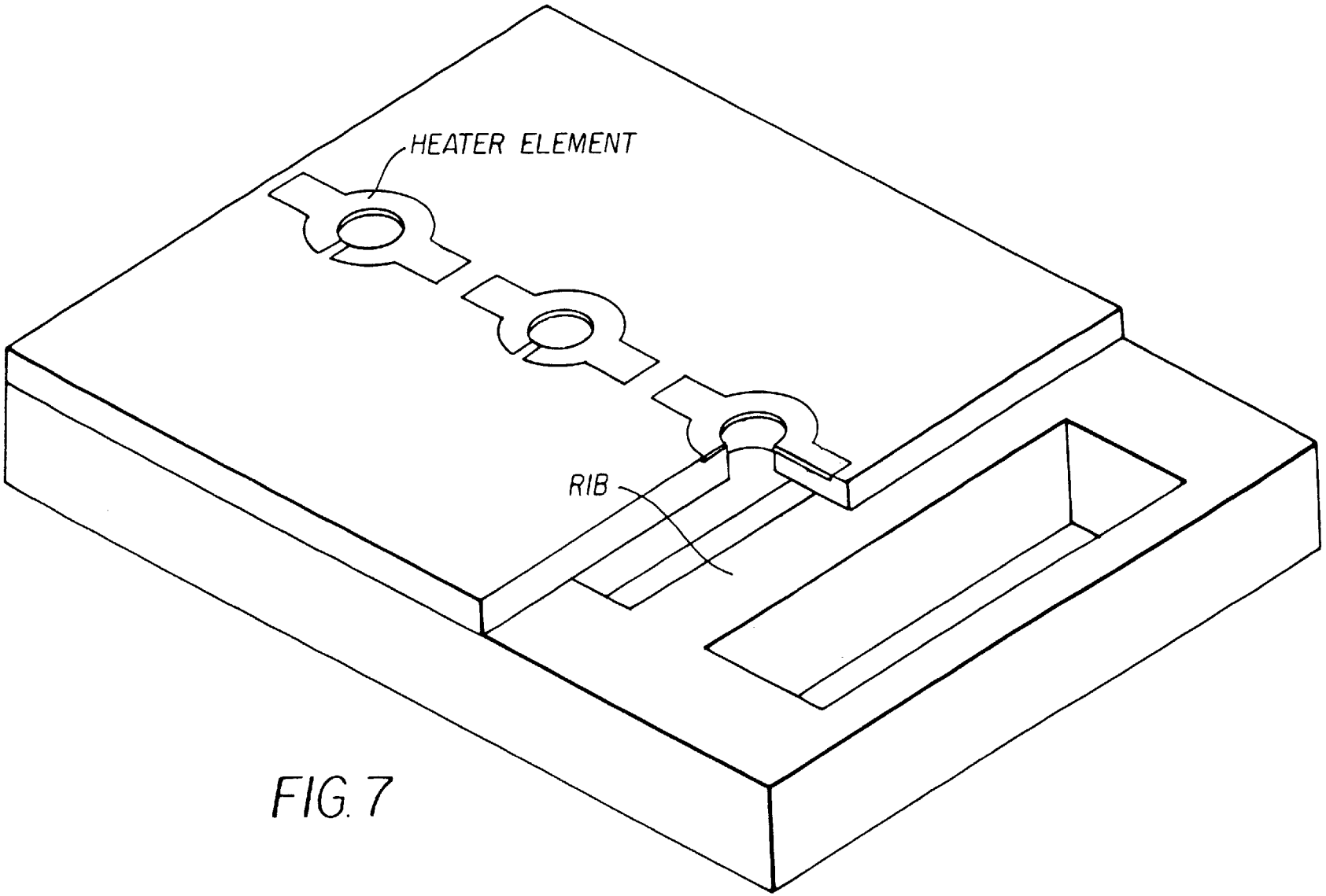
FIG. 7 is a schematic perspective view of the ink jet print head with a small array of nozzles illustrating the concept of silicon ribs being provided in ink channels between adjacent nozzles.

With reference to FIG. 5, the ink channel formed in the silicon substrate is illustrated as being a rectangular cavity passing centrally beneath the nozzle array. However, a long cavity in the center of the die tends to structurally weaken the printhead array so that if the array was subject to torsional stresses, such as during packaging, the membrane could crack. Also, along printheads, pressure variations in the ink channels due to low frequency pressure waves can cause jet jitter. Description will now be provided of an improved design. This improved design is one that will leave behind a silicon bridge or rib between each nozzle of the nozzle array during the etching of the ink channel. These bridges extend all the way from the back of the silicon wafer to the front of the silicon wafer. The ink channel pattern defined in the back of the wafer, therefore, is thus not a long rectangular recess running parallel to the direction of the row of nozzles but is instead a series of smaller rectangular cavities each feeding a single nozzle, see FIGS. 4, 6, and 7. The use of these ribs improves the strength of the silicon as opposed to the long cavity in the center of the die which as noted above would tend to structurally weaken the printhead. The ribs or bridges also tend to reduce pressure variations in the ink channels due to low frequency pressure waves which as noted above can cause jet jitter. In this example each ink channel is fabricated to be a rectangle of 20 micrometers along the direction of the row of nozzles and 120 micrometers in the direction transverse and preferably orthogonal to the row of nozzle openings.

It will be understood, of course, that although the above description is provided relative to formation of a single nozzle that the process is simultaneously applicable to a whole series of nozzles formed in a row along the wafer. This row may be either a straight line or less preferably a staggered line.

Thus, in accordance with the invention a continuous ink jet printer is provided having a relatively flat top surface highly suited for maintenance or cleaning. The printhead can be processed substantially in a conventional CMOS processing facility wherein the integrated circuits used to control the heater elements for heating of the ink stream are defined. The heater elements, bores and other structures such as the ink channels are then added in a MEMS processing facility.

Figure 9:
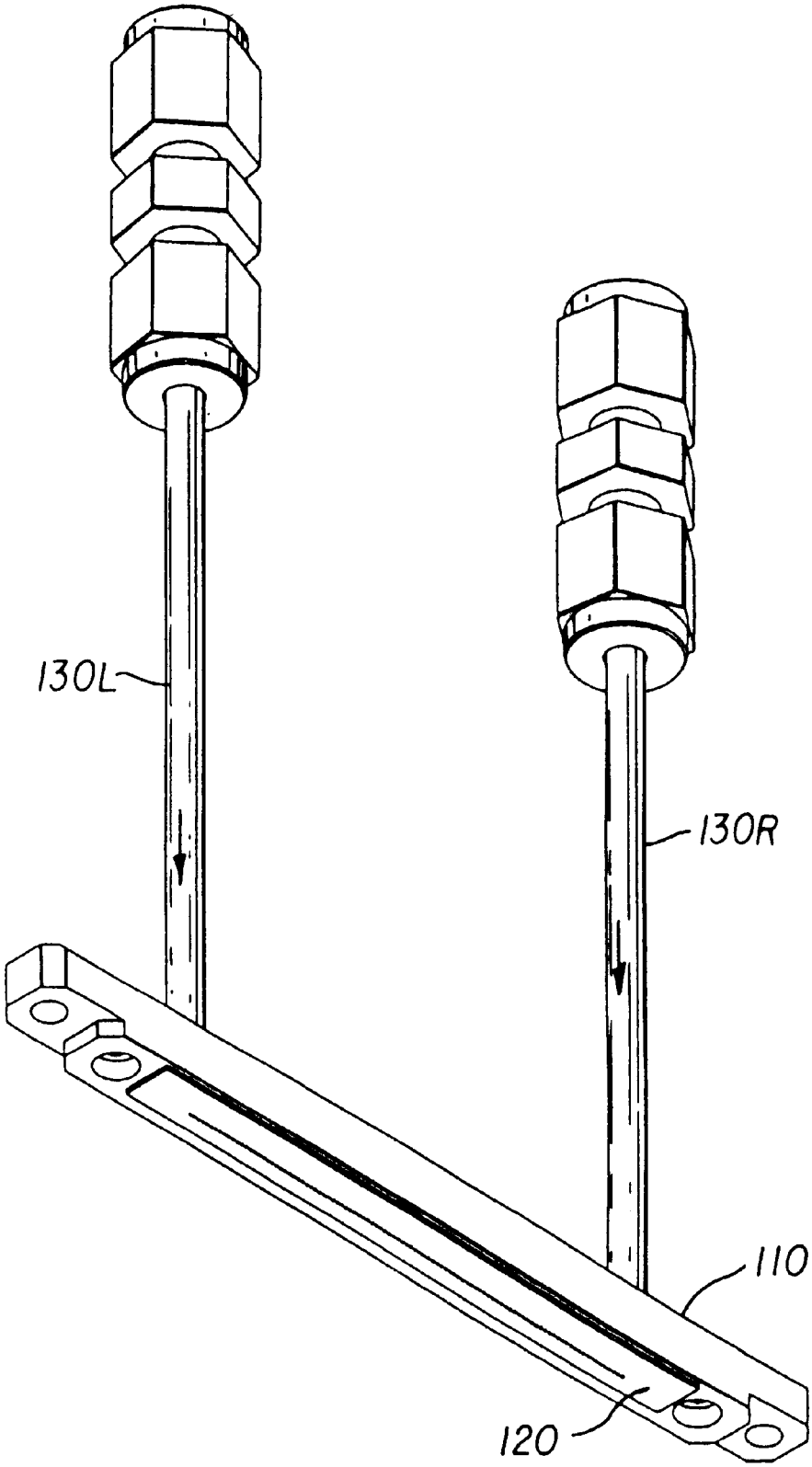
FIG. 9 is a perspective view of the CMOS/MEMS printhead formed in accordance with the invention and mounted on a supporting member into which ink is delivered.

With reference to FIG. 9, the completed CMOS/MEMS print head 120 corresponding to any of the embodiments described herein is mounted on a supporting mount 110 having a pair of ink feed lines 130L, 130R connected adjacent end portions of the mount for feeding ink to ends of a longitudinally extending channel formed in the supporting mount. The channel faces the rear of the print head 120 and is thus in communication with the array of ink channels formed in the silicon substrate of the print head 120. The supporting mount, which could be a ceramic substrate, includes mounting holes at the ends for attachment of this structure to a printer system.

Although the present invention has been described with particular reference to various preferred embodiments, the invention is not limited to the details thereof. Various substitutions and modifications will occur to those of ordinary skill in the art, and all such substitutions and modifications are intended to fall within the scope of the invention as defined in the appended claims.

What is claimed is:

1. A continuous page wide ink jet print head that extends in a page wide direction comprising:

a silicon substrate including integrated circuits formed therein for controlling operation of the print head, the silicon substrate having ink channels formed therein along the substrate;

an insulating layer or layers overlying the silicon substrate, the insulating layer or layers having a series of elongated ink jet bores each formed in the surface of the insulating layer or layers, the surface being formed generally planar, and each bore being of generally uniform diameter and extending from the surface of the insulating layer or layers and terminating at an interface between the silicon substrate and the insulating layer or layers;

each bore having located proximate thereto and near the surface of the insulating layer or layers a heater element;

each of said ink channels being associated respectively with and communicating with a respective bore so that a respective ink channel is defined between a respective pair of rib wall structures associated with each respective bore, the rib wall structures extending for a full thickness of the silicon substrate and directed in a transverse direction to the page wide direction of the print head and the rib wall structures of each pair being spaced apart a distance wider than the diameter of the respective bore to form two walls of the respective ink channel; and a gutter that is in a position for collecting ink droplets not selected for printing.

2. The ink jet print head of claim 1 wherein the insulating layer or layers includes a series of vertically separated levels of electrically conductive leads and electrically conductive vias connect at least some of said levels.

3. The ink jet print head of claim 1 wherein the insulating layer or layers is formed of an oxide.

4. The ink jet print head of claim 1 wherein the integrated circuits include CMOS devices.

5. The ink jet print head of claim 1 and wherein the nozzle bores are arranged along a straight or staggered line in the page wide direction.

6. The ink jet print head of claim 5 and wherein plural channels are provided in the silicon substrate.

7. The ink jet print head of claim 1 and wherein the heater element includes a notch for asymmetric heating of ink in the bore.

8. A method of operating a continuous page wide ink jet print head having a plurality of nozzle bores arranged as a row extending in a page wide direction, the method comprising:

providing liquid ink under pressure in each of a plurality of respective ink channels formed in a silicon substrate, the substrate having a series of integrated circuits formed therein for controlling operation of the print head;

asymmetrically heating the ink at a nozzle opening to affect deflection of ink droplet(s), each nozzle opening communicating with an ink channel and the nozzle openings being arranged as an array extending in the page wide direction;

wherein each nozzle opening is formed as a generally elongated bore of generally uniform diameter in the insulating layer or layers covering the silicon substrate, each elongated bore terminates at one end thereof at a surface of the insulating layer or layers to provide a generally planar surface that facilitates cleaning of the surface and terminates at a second end thereof at an interface between the insulating layer or layers and the silicon substrate wherein each respective bore connects with its respective ink channel, the respective ink channel being wider than the respective bore so that ink flows from the respective ink channel into the respective bore and the respective ink channel being defined by a pair of rib wall structures that are directed transverse to the direction of the page wide direction and spaced apart in the page wide direction a distance greater than the diameter of the respective bore;

a heater element is associated with each nozzle opening and located proximate the surface of the insulating layer or layers and provides the asymmetric heating of the ink as it exits the nozzle opening; and a gutter collects ink droplets not selected for printing.

9. The method according to claim 8 and wherein signals from the integrated circuit are communicated to the heater elements for controlling operation of the heater elements.

10. The method of claim 9 wherein the integrated circuits include CMOS devices.

11. The method of claim 10 wherein the insulating layer or layers includes a series of vertically separated levels of electrically conductive leads and electrically conductive vias connect at least some of the levels and signals are transmitted from the CMOS devices formed in the substrate through the electrically conductive vias.

12. A method of forming a continuous page wide ink jet print head comprising:

providing a silicon substrate having integrated circuits for controlling operation of the print head, the silicon substrate having an insulating layer or layers formed thereon, the insulating layer or layers having electrical conductors that are electrically connected to circuits formed in the silicon substrate;

forming in the insulating layer or layers a series or array of elongated ink jet bores of generally uniform diameter and arranged in a straight line or staggered configuration in a page wide direction of the print head, each bore extending from the surface of the insulating layer or layers and terminating at an interface between the insulating layer and the silicon substrate so as to communicate with a respective ink channel in the silicon substrate, the surface of the insulating layer or layers being generally planar; and forming the respective ink channels for each respective bore, the respective ink channels each comprising a pair of respective rib wall structures that extend transverse to the page wide direction, the respective rib wall structures being spaced apart a distance greater than the diameter of the respective ink jet bore and the rib wall structures extending for a full thickness of the silicon substrate; and forming an asymmetric heater element adjacent each bore on the surface of the insulating layer or layers.

13. The method of claim 12 and wherein the integrated circuits include CMOS devices.

14. The method of claim 13 wherein the insulating layer or layers includes a series of vertically separated levels of electrically conductive leads and electrically conductive vias connect at least some of said levels.

15. The method of claim 12 and wherein the insulating layer or layers is formed with a series of vertically separated levels of electrically conductive leads and electrically conductive vias connect at least some of said levels.

16. The method of claim 15 and wherein electrodes of CMOS devices are formed in the insulating layer or layers.

17. The method of claim 12 and wherein a heater element is formed with a notch for assymetric heating of ink in the bore.

18. The method of claim 12 and wherein CMOS devices are formed in the silicon substrate and electrodes of certain of the CMOS devices are formed in the insulating layer or layers.

* * * * *